US005551094A

United States Patent [19]

Navone

[11] Patent Number: 5,551,094

[45] Date of Patent: Sep. 3, 1996

[54] HELMET RETENTION SYSTEM WITH ADJUSTABLE HEADBAND

[75] Inventor: Michael V. Navone, 838 Iris Ave., Sunnyvale, Calif. 94086

[73] Assignee: Michael V. Navone, Sunnyvale, Calif.

[21] Appl. No.: 247,045

[22] Filed: May 20, 1994

[51] Int. Cl.[6] ..... A42B 3/00

[52] U.S. Cl. ..... 2/421; 2/418

[58] Field of Search ..... 2/410, 411, 413, 2/414, 417, 418, 420, 421, 425, DIG. 10, DIG. 11

[56] References Cited

U.S. PATENT DOCUMENTS

| | | | |
|---|---|---|---|
| 2,816,290 | 12/1957 | Boyer | 2/413 |
| 2,846,683 | 8/1958 | Dye | 2/421 |
| 4,051,555 | 10/1977 | Daly | 2/425 |
| 4,263,679 | 4/1981 | Erlendson | 2/421 |
| 4,888,831 | 12/1989 | Oleson | 2/420 |
| 4,901,373 | 2/1990 | Broersma | 2/421 |
| 4,903,348 | 2/1990 | Broersma | 2/421 |
| 4,903,350 | 2/1990 | Gentes et al. | 2/421 |
| 5,031,246 | 7/1991 | Kronenberger | 2/413 |
| 5,121,508 | 6/1992 | Grilliot et al. | 2/421 |
| 5,272,773 | 12/1993 | Kamata | 2/421 |
| 5,381,560 | 1/1995 | Halstead | 2/421 |

FOREIGN PATENT DOCUMENTS

| | | | |
|---|---|---|---|
| 470746 | 2/1992 | European Pat. Off. | 2/410 |

OTHER PUBLICATIONS

Advertisment for the Dial–A–Fit System by Headwinds. Seen in Bicycling Magazine vol. 35, #5 May 1994.

*Primary Examiner*—Michael A. Neas

[57] ABSTRACT

A bicycle helmet with an improved retention system uses an adjustable headband and straps to secure the helmet to the user's head. The headband is adjustably angled in relation to the helmet such when the helmet is worn in the proper position with the bottom edge of the helmet situated approximately horizontally, the angled headband fits comfortably and securely around the user's head. The headband and strap adjustability provides comfort, stability and air circulation to the wearer during cycling and secure protection to the head during an impact. The headband attaches securely to the helmet and in the case of an impact would evenly distribute the force of the impact over a larger area of the head decreasing the chances of serious injury. The system may be retrofitted to the user's current helmet. The retention system is also removable so that the system may be washed or replaced. Embodiments with an adjustable headband, a custom-fitted headband and an adjustable headband with an inflatable air bladder system are disclosed.

6 Claims, 5 Drawing Sheets

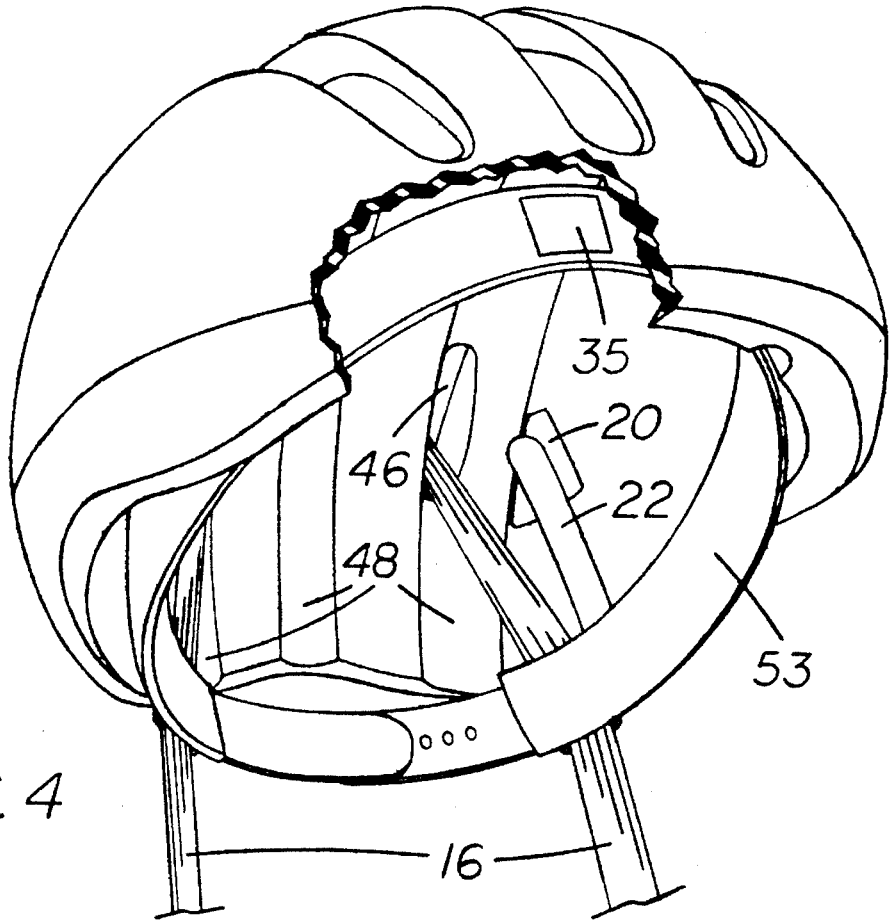
FIG. 4
FIG. 5
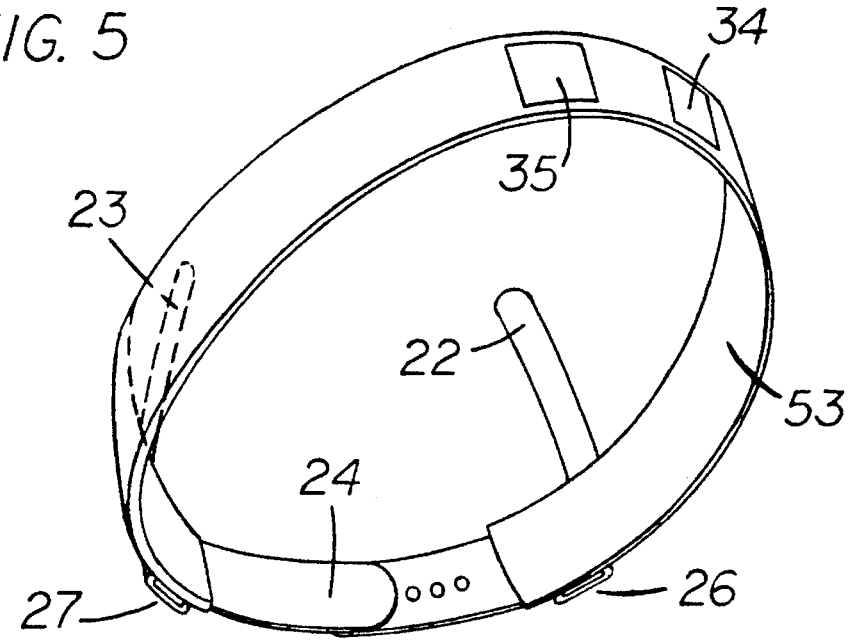

FIG. 6
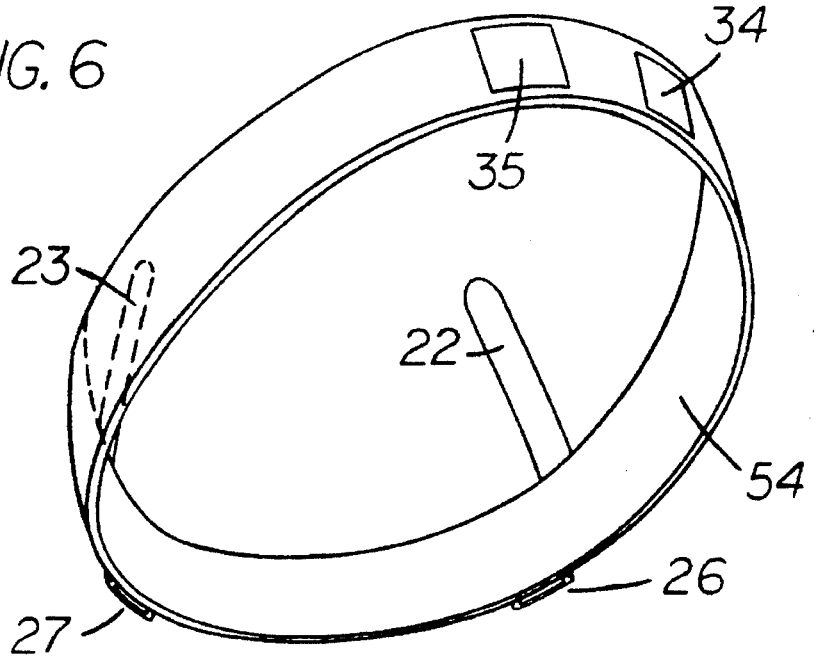
FIG. 7
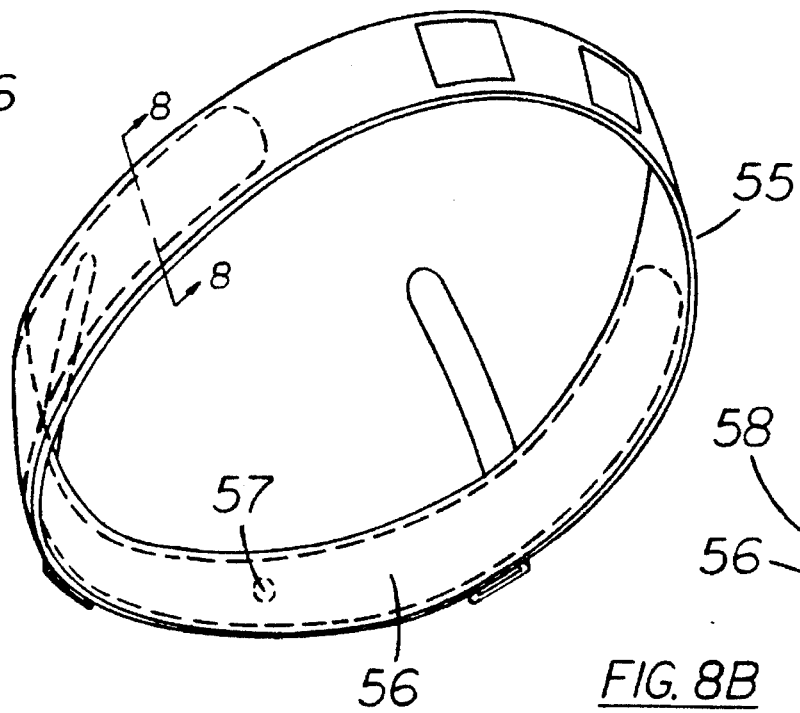
FIG. 8A
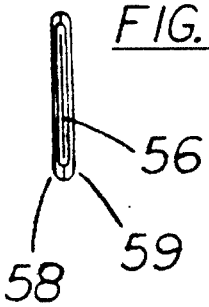
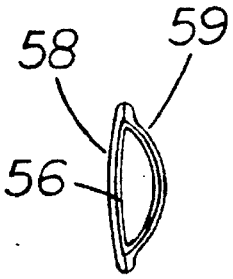
FIG. 8B

HELMET RETENTION SYSTEM WITH ADJUSTABLE HEADBAND

BACKGROUND

1. Field of Invention

This invention relates generally to retention systems for protective helmets and more particularly, to improvements in retention systems utilized for bicycle helmets.

2. Description of Prior Art

Protective helmets are widely used in industry and sporting activities as hard hats, crash helmets, ski helmets, bicycle helmets, and the like. Such helmets comprise a protective body designed to distribute the load of any localized impact over a larger area. The helmet is supported by the head of the wearer during use. Various helmet retention systems have been devised to provide comfort and fit to the wearer while continuing to provide the desired protection.

Helmet retention systems designed for use with bicycle helmets should have the following characteristics:

(a) The means to retain the helmet on the wearer's head during an impact to the helmet from any direction, front, rear, sides, or top, that may result from a crash while operating a bicycle.

(b) The means to hold the helmet on the wearer's head in the proper horizontal position, covering the forehead, for maximum crash protection.

(c) The means to hold the helmet securely on the wearer's head so the helmet is stable and does not shift and slide on the head during normal movement involved with cycling.

(d) System should be fully adjustable to fit varying head sizes within a selected range.

(e) System should be fully adjustable to engage the wearers head in a preferred position.

(f) System should provide good wearer fit and comfort while cycling.

One type of helmet retention system that contains many of these characteristics is a system incorporating an adjustable headband. A typical "Hard Hat" retention system disclosed in Erlendson U.S. Pat. No. 4,263,679, 4/28/81 incorporates a generally horizontal adjustable headband with an attached rear band that engages the nape area of the user's head. Another similar design by Daly U.S. Pat. No. 4,051,555, 10/4/77 incorporates an adjustable headband where the rear portion of the headband slopes downward to engage the nape area of the wearer's head.

These designs provide good fit, stability, and comfort for the wearer while holding the helmet in its proper horizontal position. However, these types of helmet retention systems would not provide adequate protection from the substantial impacts associated with a bicycle crash. These helmet retention systems do not provide helmet retaining straps secured under the wearer's chin and consequently can be dislodged from the wearer's head during a crash.

Dye U.S. Pat. No. 2,846,683, Oct. 12, 1956 discloses an improved helmet retention system which utilizes a headband with the addition of helmet retaining straps secured under the wearer's chin. This type of retention system will securely hold the helmet on the wearer's head during a crash. The system will also provide the wearer with good helmet fit, stability, and comfort. However, the design's lack of an impact absorbing body and the complexity of its headband, and support system would make it difficult to use in a bicycle helmet retention system.

Present day bicycle helmet designs like those disclosed in Broersma U.S. Pat. No. 4,901,373, 2/20/90 and Broersma U.S. Pat. No. 4,903,348, 2/27/90 consist of a dome shaped helmet body made from an impact absorbing material, typically molded from expanded polystyrene. The helmet body has inner and outer surfaces. Openings through the front and rear of the body allow retention straps to pass through. Helmet retention is accomplished by retention straps passing across the outer surface of the helmet body then extending down through the openings in the body. The retention straps continue down the sides of the wearer's head and are joined under the chin with a buckle.

Since the helmet body's inner surface is larger than the wearer's head; foam cushion pads are used on the top, and lower rim of the inner surface of the helmet body to seat the helmet on the head of the wearer. The foam cushion pads provide comfort, fit, and helmet stability for the wearer.

It is important to note that these foam cushion pads are utilized for stability, comfort, and fit only; they play a very small part in the impact absorbing characteristics of a bicycle helmet. Bicycle helmet manufacturers generally provide several sets of foam cushion pads in various thicknesses to allow one size of helmet body to fit several different head sizes. This method has several disadvantages:

(a) When the size difference between the helmet body's inner surface and the wearer's head is large; thick foam cushion pads must be used to properly seat the helmet on the wearer's head. The use of thick pads can flex and compress, degrading helmet fit and stability. This is a common problem for users whose head size falls in between standard ( small, medium, and large ) helmet sizes.

(b) Typically, a limited number of foam cushion pads are placed around the lower rim of the inner surface of the helmet body to contact the wearer's head. This limited number of pads must support the weight of the helmet, and forces from the retention straps; causing uncomfortable "pressure points" around the wearer's head.

(c) The foam cushion pads of the helmet contact the wearer's head in a generally horizontal, annular contact area, set just above the ears. This is not a natural position for head wear to sit on the head. Novice cyclists tend to wear their bicycle helmet in a more natural inclined position, higher up on the forehead. However, this position degrades the helmet's ability to protect the wearer's forehead.

OBJECTS AND ADVANTAGES

With the foregoing in view, several objects and advantages of the present invention are;

(a) to provide a helmet retention system which includes an adjustable headband in combination with front and rear retention straps secured under the user's chin; to improve helmet retention during an impact to the helmet from any direction.

(b) to provide in combination with a helmet retention system as described above a means to affix the adjustable headband to the rear retention straps; improving helmet retention during an impact to the helmet from the rear.

(c) to provide a helmet retention system that replaces the foam cushion pads placed around the lower rim of the inner surface of the helmet body with an adjustable headband. The headband provides a large contact surface between the user's head and helmet to better distribute the loads produced by the helmet and retention straps. The continuous contact area of the headband eliminates the "pressure points" caused by the foam cushion pads; thus, improving user comfort.

(d) to provide a helmet retention system with an adjustable headband that can be adjusted for fitting heads of varying sizes within a selected range.

(e) to provide a helmet retention system that utilizes an adjustable headband which includes the means for vertically adjusting both the front and rear portions thereof. This allows the headband to be worn in a natural inclined position, similar to the way a baseball cap is worn; while holding the helmet in a protective horizontal position.

(f) to provide a helmet retention system which utilizes an adjustable headband with an improved means of attachment to the helmet body's inner surface;to insure good helmet stability during use.

(g) the ability to easily remove the helmet retention system's adjustable headband for washing to improve hygiene and user comfort.

(h) the ability to replace the helmet retention system's adjustable headband with a custom sized headband designed to fit a particular user, providing even more improved fit and comfort for that user.

(i) the ability to replace the helmet retention system's adjustable headband with a headband containing an air bladder, and inflation / deflation valve, to provide an improved air cushion fit.

(j) the ability to install an adjustable headband as described in my helmet retention system into a pre-existing bicycle helmet, thereby converting that helmet's previous retention system into a helmet retention system with the aforementioned advantages of this invention.

These and other objects and advantages of my helmet retention system, as well as the details of the illustrative embodiment, will become more fully understood from the specification and drawings, in which:

BRIEF DESCRIPTION OF THE DRAWINGS

FIG. 4 is a front perspective view thereof. Front retention straps removed for clarity, cutaway on helmet reveals hidden detail.

FIG. 5 is a front perspective view of an adjustable headband.

FIG. 6 is a front perspective view of a custom sized headband.

FIG. 7 is a front perspective view of a headband with an air bladder.

FIG. 8A is a cross sectional view along the line 8—8 of FIG. 7 illustrating the air bladder when deflated.

FIG. 8A is a cross sectional view along the line 8—8 of FIG. 7 illustrating the air bladder when inflated.

Figure 1:
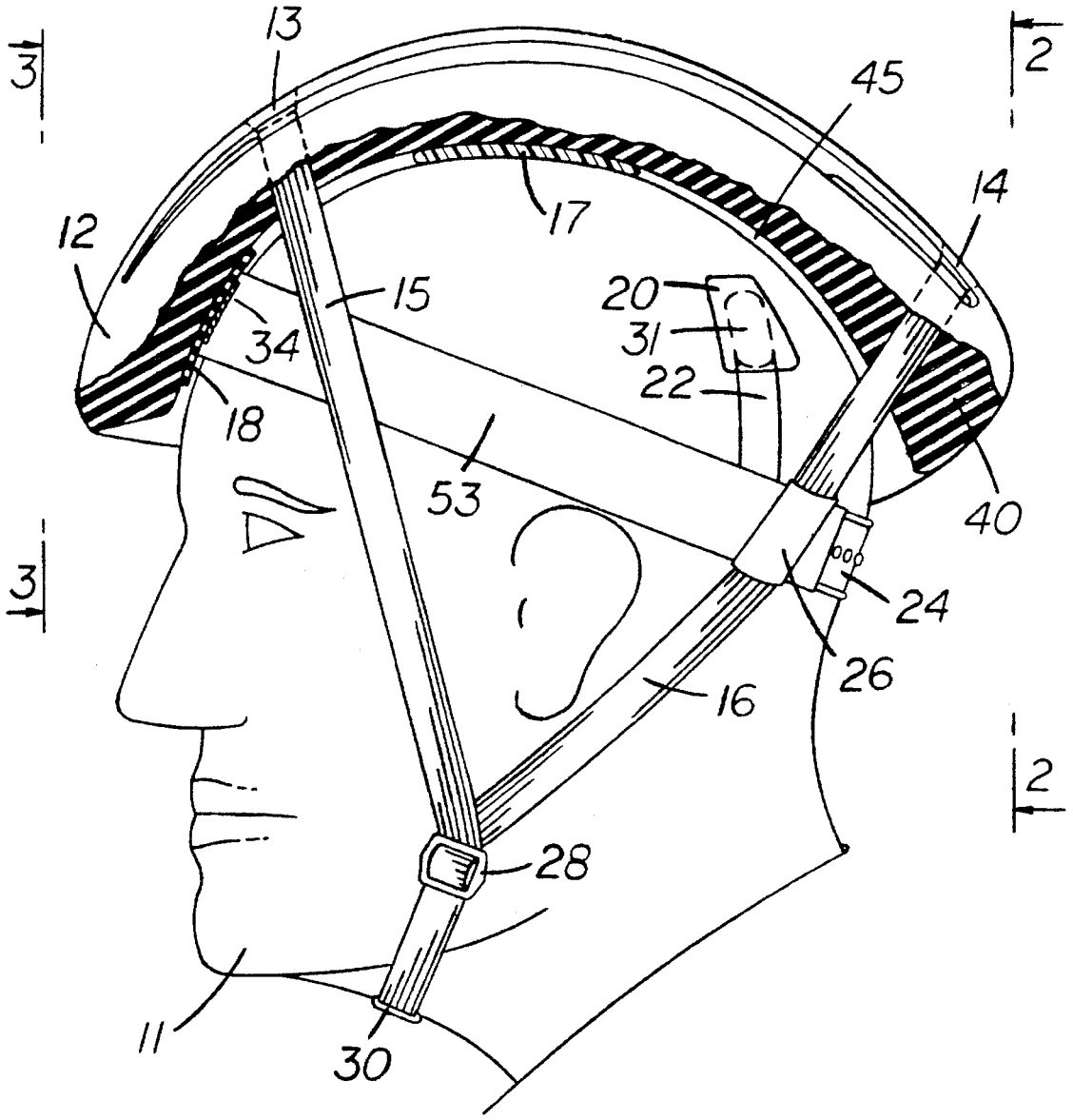
FIG. 1 is a partially cutaway side view of the helmet retention system in accordance with the embodiment of this invention.

| Reference Numerals In Drawings |
|---|
| 11 Head of helmet user or wearer |
| 12 Helmet |
| 13 Front strap slot |
| 14 Rear strap slot |

-continued

| Reference Numerals In Drawings |
|---|
| 15 Front retention strap |
| 16 Rear retention strap |
| 17 Foam cushion pad |
| 18 Left front "hook" fastener pad |
| 19 Right front "hook" fastener pad |
| 20 Left rear "hook" fastener pad |
| 21 Right rear "hook" fastener pad |
| 22 Left headband support strut |
| 23 Right headband support strut |
| 24 Headband size adjustment strap |
| 26 Left strap holder |
| 27 Right strap holder |
| 28 Left strap guide |
| 29 Right strap guide |
| 30 Attachment buckle |
| 31 Left rear "loop" fastener pad |
| 32 Right rear "loop" fastener pad |
| 34 Left front "loop" fastener pad |
| 35 Right front "loop" fastener pad |
| 40 Helmet body |
| 41 Protective helmet shell |
| 42 Inner surface of helmet body |
| 45 Gap |
| 46 Rear helmet body openings or rear vents |
| 47 Front helmet body openings or front vents |
| 48 Internal channels |
| 53 Adjustable headband |
| 54 Custom sized headband |
| 55 Headband with air bladder |
| 56 Air bladder |
| 57 Inflation/deflation valve |
| 58 Outer layer of headband with air bladder |
| 59 Inner layer of headband with air bladder |

DETAILED DESCRIPTION OF THE INVENTION

Referring to FIG. 1 of the drawings, the embodiment of the present invention is shown in a side view, with the helmet 12 shown in a partially cutaway view to illustrate an impact absorbing helmet body 40, generally molded from expanded polystyrene or other rigid foam. The cutaway view of FIG. 2 also shows a protective shell 41; usually made from polypropylene, or other tough plastic, that covers the top half of the outer surface of the helmet body 40, also shown in FIG. 3.

FIG. 1 also illustrates the position of a front retention strap 15, and a rear retention strap 16, along with an adjustable headband 53 when they are in contact with the head of the user 11. The user's head 11 engages a top section of the inner surface of the helmet body 42 through a foam cushion pad 17; a gap 45 exists between the inner surface of the helmet body 42, and the user's head 11. Note that the adjustable headband 53 is inclined approximately twenty five degrees from a horizontal position.

Figure 2:
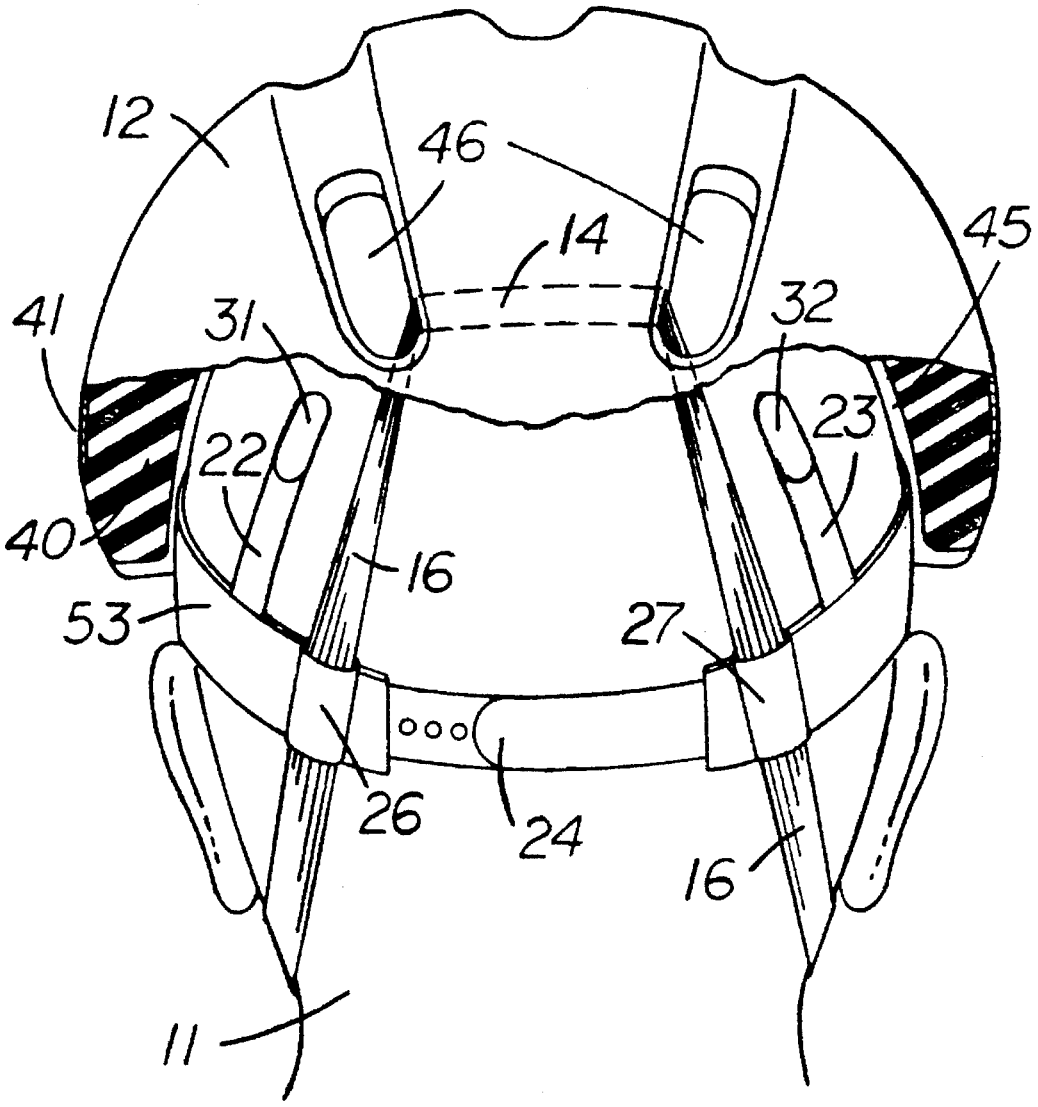
FIG. 2 is a rear view thereof with the helmet partially cut away.
Figure 3:
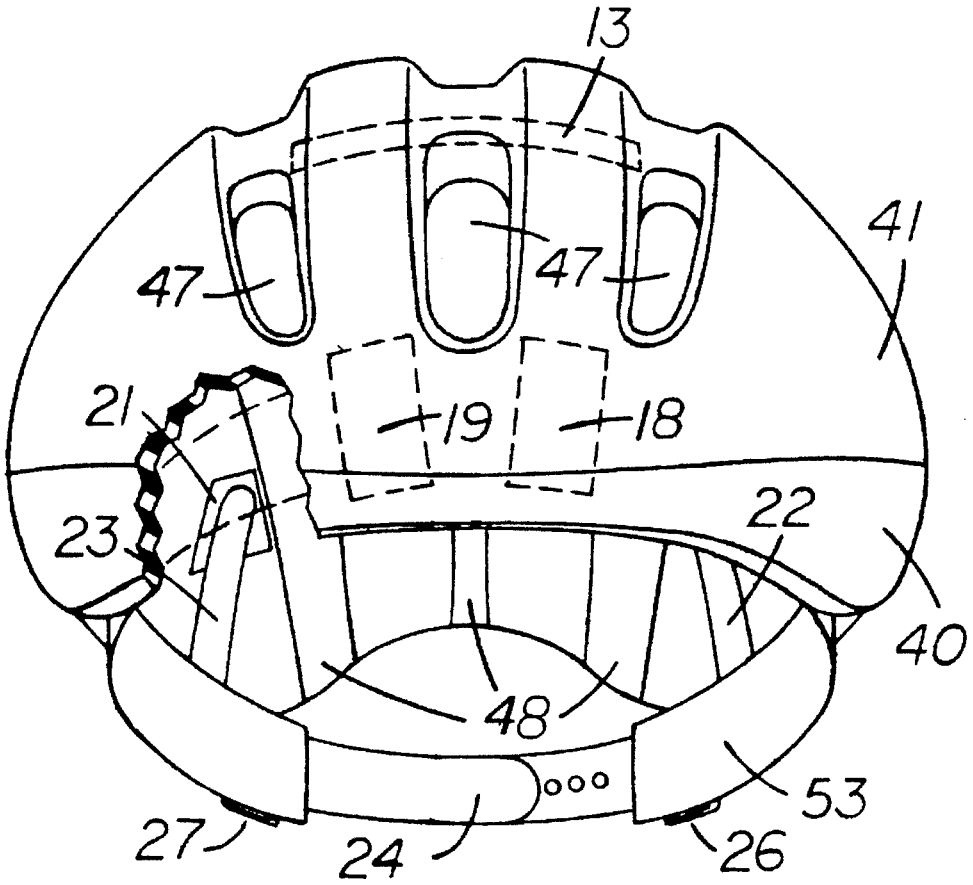
FIG. 3 is a front view thereof with retention straps, and head of user removed for clarity, cutaway on helmet reveals hidden detail.

As depicted in FIGS. 2 and 3, extending across the upper-mid section of the front and rear outer surface of the helmet body 40 are depressed surface channels or front and rear strap slots 13 and 14 for receiving the front and rear retention straps 15 and 16 as shown in the dashed lines of FIG. 2 and 3. At each end of the front and rear strap slots 13 and 14, front and rear openings 47 and 46 extend through the helmet body 40 so that the front and rear retention straps 15 and 16 may be passed to the interior portion thereof.

Now referring to FIGS. 1 and 2 of the drawings, it will be noted that retention straps 15 and 16 are formed of a single length of material, usually flat nylon webbing, one end of which is attached to a male portion of an attachment buckle 30. The strap is then passed through a left strap guide 28 (see FIG. 1) and extends up through a left strap holder 26 then through a rear opening 46 to the outer surface and then back through the other rear opening 46 (see FIG. 2) to the interior of the helmet and through a right strap holder 27 then down through a right guide 29 (not shown), after which it is looped around a female portion of a attachment buckle 30 and returned through right guide 29 for subsequent passage up through front openings 47 (see FIG. 3) and then returned down through left guide 28 so that the other end may likewise be attached to the male portion of the attachment buckle 30.

Now referring to FIGS. 2, 3, and 4 to illustrate how the adjustable headband 53 is secured to the inner surface of the helmet body 42, comprising left and right hand sections. A left and right rear "hook" fastener pad 20 and 21 (see FIG. 4 and 3) affixed to the left and right rear inside surface of the helmet body 42 attaches to a left and right rear "loop" fastener pad 31 and 32 (see FIG. 2) affixed to a left and right headband support strut 22 and 23 (see FIG. 2) which projects down into the left and right rear portion of the adjustable headband 53, respectively.

A left and right front "hook" fastener pad 18 and 19 affixed to the left and right front inside surface of the helmet body 42 (see FIG. 3) attaches to a left and right front "loop" fastener pad 34 and 35 (see FIG. 1 and 4) affixed to the outer left and right front portion of the adjustable headband 53, respectively.

FIG. 4 also illustrates the internal channels 48 molded into the helmet shell 40. These channels run from the front to the rear of the inside surface of the helmet shell 42. The internal channels 48 form air passages between the front and rear vents 47 and 46 to facilitate cooling of the user's head.

Now referring to FIG. 5 to illustrate the embodiment of the main component of my helmet retention system, the adjustable headband 53 and its integral components. The adjustable headband 53 is fabricated from either thin plastic or some type of reinforced fabric, to make the headband semi-rigid so that it retains a hoop shape. The left and right headband support struts 22 and 23 project up and out of the rear section of the adjustable headband 53. The struts are approximately two inches long and are made of a similarly semi-rigid material. Also shown in FIG. 2 are the left and right strap holders 26 and 27, made from one inch sections of tubular nylon webbing, or other suitable material, affixed to the left and right sides of the rear section of the adjustable headband 53. Left and right front "loop" fastener pads 34 and 35 are affixed to the front section of the adjustable headband 53. The headband size adjustment strap 24, consisting of two tabs, one containing a number of equally spaced pegs and the second containing the same number of equally spaced holes, is integrated into the rear section of the adjustable headband 53. Headband adjustment is accomplished by overlapping the two tabs and locking a number of pegs into the corresponding holes needed for a good fit. Note that other various systems to increase and decrease the diameter of the headband can be utilized in place of the headband adjustment strap 24.

FIG. 6 illustrates the embodiment of a custom sized headband 54 designed to fit an individual user. This custom sized headband 54 contains the same integral components and performs the same functions in my bicycle helmet retention system as the adjustable headband 53 detailed in FIG. 5. However, the custom sized headband does not contain the headband size adjustment strap 24, rather the headband is made from a single continuous band of material.

FIG. 7 illustrates the embodiment of a headband 53 with an air bladder 56. This headband with an air bladder 56 contains the same integral components and performs the same functions in my bicycle helmet retention system as the adjustable headband 53 detailed in FIG. 5. However, an air bladder 56 is contained within the rear two thirds of the headband. This air bladder can be inflated and deflated through a valve mechanism 57 in the rear of the headband.

FIG. 8A shows a cross sectional view of the headband with an air bladder 56 taken along the line 8—8 of FIG. 7. This view shows the air bladder 56 deflated and flat, contained within the inner and outer layers 59 and 58 of the headband. FIG. 8B is a view of the same cross section along line 8—8 of FIG. 7; however, the air bladder 56 is now inflated.

OPERATION OF THE INVENTION

In use helmet 12 is seated on the user's head as illustrated in FIG. 1 and front and rear retention straps 15 and 16 are passed around the head and held in engagement therewith by guides 28 and 29 and attachment buckle 30.

FIG. 1 illustrates where the front retention straps 15 engage an area of the user's head from the upper portion of the temple to the lower jaw. The straps then pass through the left and right strap guides 28 and 29 and proceed down under the chin where they are secured to the male and female portions of the attachment buckle 30. FIG. 2 illustrates where the rear retention straps 16 engage an area of the user's head from the upper portion of the nape, where they pass through the left and right strap holders 26 and 27, affixed to the rear section of the adjustable headband 53, to the lower jaw. The straps then pass through the left and right strap guides 28 and 29 and proceed down under the chin where they are secured to the male and female portions of the attachment buckle 30. Note that the left and right strap holders 26 and 27 hold the rear retention straps 16 in a fixed position, preventing the straps from sliding forward on the user's head.

In accordance with the present invention, the front and rear retention straps 15 and 16 engage the user's head in the before mentioned areas to insure the helmet will remain securely seated on the user's head during an impact to the helmet.

An alternate embodiment not shown; but which is identical in all respects to the embodiment shown in FIG. 2, except that the strap holders 26 and 27 are removed from the adjustable headband 53. This alternate embodiment would allow the rear retention straps 16 to simply pass over the rear portion of the adjustable headband 53 without being physically linked to the headband.

FIG. 1 also illustrates the gap 45 that exists between the inner surface of the helmet body 42 and the head of the user 11. The head of the user 11 only contacts the adjustable headband 53 and the foam cushion pad 17. In essence, the inner surface of the helmet body 42 floats above the head of the user 11, facilitating air flow and improving user comfort.

FIG. 5 illustrates the embodiment of the main component of my helmet retention system, the adjustable headband 53 and its integral components. The headband size adjustment strap 24 is integrated into the rear section of the adjustable headband 53 to allow the adjustable headband to fit many different head sizes over a selected range. Left and right headband support struts 22 and 23 extend up out of the rear portion of the headband. The struts are rigid enough to stabilize the weight of the helmet 12 while being worn on the user's head 11.

The adjustable headband 53 is secured to helmet by "hook" fastener pads 18, 19, 20, and 21 affixed to the inner surface of the helmet body 42 which attach to their corresponding "loop" fastener pads 34, 35, 31, and 32 which are affixed to the front section of the adjustable headband 53 and to the support struts 22 and 23.

Note that each individual "hook" fastener pad 18, 19, 20, and 21 is much larger in area than its "loop" fastener pad counterpart 34, 35, 31, and 32. This allows the "loop" fastener pads of the adjustable headband 53 to contact their corresponding "hook" fastener pads from a range of headband positions (high, low, and inclined) within the inner surface of the helmet shell 42. Typically, the headband will be worn inclined ten to thirty five degrees from a horizontal plane depending on user preference. This range of contact also allows the helmet 12 to remain in a horizontal orientation on the user's head, independent of the position of the adjustable headband 53, to maximize helmet protection while improving user comfort.

The custom sized headband 54 illustrated in FIG. 6 contains the same integral components and performs the same functions in my helmet retention system as the adjustable headband 53 detailed in FIG. 5. However; the custom sized headband 54 does not contain the headband size adjustment strap 24. Rather, the custom sized headband 54 is manufactured to a particular circumference or diameter to fit a particular user. Helmet retention systems utilizing this custom sized headband 54 could be manufactured and sold in common English or metric hat sizes.

The headband 55 with an air bladder 56 illustrated in FIG. 7 contains the same integral components and performs the same functions in my helmet retention system as the adjustable headband 53 detailed in FIG. 5. However; an air bladder 56 is contained within the rear two thirds of the headband. The air bladder can be inflated and deflated through a valve mechanism 57 in the rear of the headband. A slightly loose fitting headband 55 with an air bladder 56 would be placed on the user's head, then the air bladder 56 would be inflated, causing the headband to tighten around, and conform to the user's head.

FIG. 8B shows how the inflated bladder causes the inside layer of the headband 59 to bulge inward, reducing the diameter of the inside surface of the headband. This reduction in diameter of the inside surface of the headband 59 will allow a slightly loose fitting headband with an air bladder to tighten around the user's head when the air bladder 56 is inflated, facilitating user fit and comfort.

FIGS. 5, 6, and 7 illustrate the embodiment of the headband component of my helmet retention system removed from that system and helmet. This ability to remove the headband allows the user to remove and wash the headband when it becomes soiled. The "loop" fastener pads are utilized on the headband component of the helmet retention system to prevent the headband from snagging other articles of clothing during washing.

The ability to remove the headband also allows the user to install the headband into an existing helmet of similar design. The user only needs to remove the foam cushion pads around the inner rim of the existing helmet. Then the user must affix "hook" fastener pads (like pads 18, 19, 20, and 21) in the proper locations on the inner surface of the existing helmers body to engage the "loop" fastener pads 34, 35, 31, and 32 of the headband. In this manner, an existing helmet retention system can be converted into a helmet retention system which embodies the objects and advantages of my helmet retention system.

While my above description contains many specificities, these should not be construed as limitations on the scope of the invention, but rather as an exemplification of one preferred embodiment thereof. Many other variations are possible. Accordingly, the scope of the invention should be determined not by the embodiments illustrated, but by the appended claims and their legal equivalents.

I claim:

1. In a protective helmet, the combination comprising:

a protective helmet body having a front and a back, said helmet body having a lower rim, said lower rim of said helmet body being situated approximately horizontally with respect to a head of a wearer, a headband member which encircles said head of said wearer, said headband member having a front portion and a back portion, means for attaching said front portion of said headband member to said helmet body proximate said front of said helmet body at least one upwardly extending strut attached to said back portion of said headband member, said at least one upwardly extending strut having an upper end, said upper end having a means for attaching said upper end to said helmet body proximate said back of said helmet body, and at least one retention strap member attached to said helmet body for engaging the chin of the wearer, wherein said headband member is inclined with respect to said lower rim of said protective helmet body such that said front portion of said headband member is higher than said back portion of said headband member and wherein said headband member further comprises a left strap holder for slidably attaching said left back strap to the left side of said headband member proximate said back portion of said headband member, and a right strap holder for slidably attaching said right back strap to the right side of said headband member proximate said back portion of said headband member.

2. In a protective helmet, the combination comprising:

a protective helmet body having a front and a back, said helmet body having a lower rim, said lower rim of said helmet body being situated approximately horizontally with respect to a head of a wearer, a headband member which encircles said head of said wearer, said headband member having an adjustment means for adjusting the size of said headband member to fit the size of said head of said wearer, said headband member having a front portion and a back portion, an adjustable attachment means for movably attaching said front portion of said headband member to said helmet body proximate said front of said helmet body at a desired position with respect to said front of said helmet body and said lower rim of said helmet body, at least two upwardly extending struts attached to said back portion of said headband member, including a left rear strut and a right rear strut, said left rear strut having an upper end having an adjustable attachment means for attaching said upper end of said left rear strut to the left side of said helmet body proximate said back of said helmet body at a desired position with respect to said back of said helmet body and said lower rim of said helmet body, said right rear strut having an upper end having an adjustable attachment means for attaching said upper end of said right rear strut to the right side of said helmet body proximate said back of said helmet body at a desired position with respect to said back of said helmet body and said lower rim of said helmet body, wherein said headband member is inclined at an angle between approximately ten degrees and approximately thirty five degrees with respect to said lower rim of said protective helmet body such that said front portion of said headband member is higher than said back portion of said headband member, a front retention strap member and a back retention strap member, said front retention strap member having means for attaching to said helmet body proximate said front of said helmet body, said front retention strap member having a left front strap and a right front strap depending downward below said lower rim of said helmet body proximate said front of said helmet body, said back retention strap member having means for attaching to said helmet body proximate said back of said helmet body, said back retention strap member having a left back strap and a right back strap depending downward below said lower rim of said helmet body proximate said back of said helmet body, said left front strap and said left back strap joining together to form a left chin strap, said right front strap and said right back strap joining together to form a right chin strap, and a fastening means for fastening said left chin strap to said right chin strap beneath the chin of said wearer, and a left strap holder for slidably attaching said left back strap to the left side of said headband member proximate said back portion of said headband member, and a right strap holder for slidably attaching said right back strap to the right side of said headband member proximate said back portion of said headband member.

3. The combination of claim 2 wherein said adjustment means comprises a first tab having a plurality of equally spaced pegs extending therefrom and a second tab having a plurality of equally spaced holes therethrough and adjustment of said adjustment means is accomplished by overlapping said first tab and said second tab and interlocking at least one of said pegs with at least one of said holes to fit said headband member to the size of said head of said wearer.

4. The combination of claim 2 wherein said adjustment means comprises an inflatable bladder within said headband member, said inflatable bladder being inflatable to constrict the size of said headband member to fit said headband member to the size of said head of said wearer.

5. The combination of claim 2 wherein said helmet body has an interior and an exterior, and the means for attaching said front retention strap member to said helmet body proximate said front of said helmet body comprises a left front hole and a right front hole through said helmet body, and said front retention strap member passes from said interior of said helmet body through said left front hole, across said exterior of said helmet body to said right front hole and through said right front hole to said interior of said helmet body, and the means for attaching said back retention strap member to said helmet body proximate said back of said helmet body comprises a left back hole and a right back hole through said helmet body, and said back retention strap member passes from said interior of said helmet body through said left back hole, across said exterior of said helmet body to said right back hole and through said right back hole to said interior of said helmet body.

6. The combination of claim 2, wherein said front retention strap member and said back retention strap member are formed of a single continuous member.

* * * * *